US005135135A

United States Patent [19]

Olivier

[11] Patent Number: 5,135,135

[45] Date of Patent: Aug. 4, 1992

[54] DISPENSER FOR CARDED PRODUCTS

[76] Inventor: Archie A. Olivier, 3700 Glover Dr., Plano, Tex. 75074

[21] Appl. No.: 628,465

[22] Filed: Dec. 17, 1990

Related U.S. Application Data

[63] Continuation of Ser. No. 475,383, Feb. 5, 1990, abandoned.

[51] Int. Cl.[5] ..... B65G 59/00

[52] U.S. Cl. ..... 221/281; 221/303; 221/311; 206/461; 206/806; 211/59.2; 312/42

[58] Field of Search ..... 221/107, 155, 242, 281, 221/310, 311, 303, 305; 312/42, 45; 206/316.1, 389, 461, 806; 211/49.1, 59.2, 126

[56] References Cited

U.S. PATENT DOCUMENTS

| | | | |
|---|---|---|---|
| 1,782,597 | 11/1930 | Blackman | 221/311 X |
| 2,360,573 | 10/1944 | Mena | 221/311 |
| 3,215,267 | 11/1965 | Potter | 206/806 X |
| 3,744,866 | 7/1973 | Cook | 312/42 |
| 3,985,232 | 10/1976 | Johnson | 206/806 X |
| 4,037,756 | 7/1977 | Jaquish | 221/242 |
| 4,387,810 | 6/1983 | Crasslen | 312/42 X |
| 4,566,596 | 1/1986 | Hennig | 312/42 X |

FOREIGN PATENT DOCUMENTS

| | | | |
|---|---|---|---|
| 0520192 | 1/1956 | Canada | 221/311 |
| 0804358 | 10/1936 | France | 221/311 |

*Primary Examiner*—David H. Bollinger
*Assistant Examiner*—Tuan N. Nguyen
*Attorney, Agent, or Firm*—Jack A. Kanz

[57] ABSTRACT

Storage, display and dispensing apparatus for carded product is disclosed. The dispenser has front and back faces and opposite side faces defining a channel adapted to contain carded product in a vertically nested arrangement. An opening is provided in the lower end of the front face which permits only the lowermost product to be removed from the channel.

6 Claims, 2 Drawing Sheets

DISPENSER FOR CARDED PRODUCTS

FIELD OF THE INVENTION

This application is a continuation of application Ser. No. 07/475,383 filed Feb. 5, 1990, now abandoned.

This invention relates to merchandising displays. More particularly, it relates to apparatus for storing, displaying and dispensing products mounted on a display card and the like.

BACKGROUND OF THE INVENTION

Many products are packaged for retail sale in packaging configurations which permit advertising display in connection with the product. The product itself is usually contained in a blister package, box or other relatively small container which is affixed to or forms a part of a relatively flat, thin display card upon which advertising copy or other information is graphically displayed. For storage and display at the point of sale, the card portion of the package usually contains a hole centrally positioned above the product container so that the carded product may be hung from a pegboard display or the like. Multiple carded products are generally hung from a single peg in a back-to-front relationship so that the customer may select a product only by removing the outermost product. This arrangement, however, is inconvenient for stocking and stock rotation purposes since all the carded products must be removed from each peg in order to place new product on the peg behind the older product. The older product must either be re-hung on the peg so that the older product (the one selected by the purchaser) is always removed before the newer product. Furthermore, since the carded product occupies a volume of space defined by the largest dimensions thereof, an inordinate amount of display space is wasted, thus limiting the number of carded product packages which may be stored in a given amount of display space.

In accordance with the present invention, a gravity-feed dispensing display apparatus is provided in which carded products may be stored and displayed. The apparatus is arranged to permit dense vertical nesting of the carded product so that each product occupies only a minimum amount of space. Furthermore, the apparatus is arranged so that the products may only be removed from the dispenser in the order in which they were inserted. Accordingly, the oldest product is always the product ready for removal. New supplies of product may be added to the dispenser without removing older product, thus stocking time is minimized while product rotation is assured. Other features and advantages of the invention will become more readily understood from the following detailed description taken in connection with the appended claims and attached drawing in which:

DESCRIPTION OF THE PREFERRED EMBODIMENT

Figure 3:
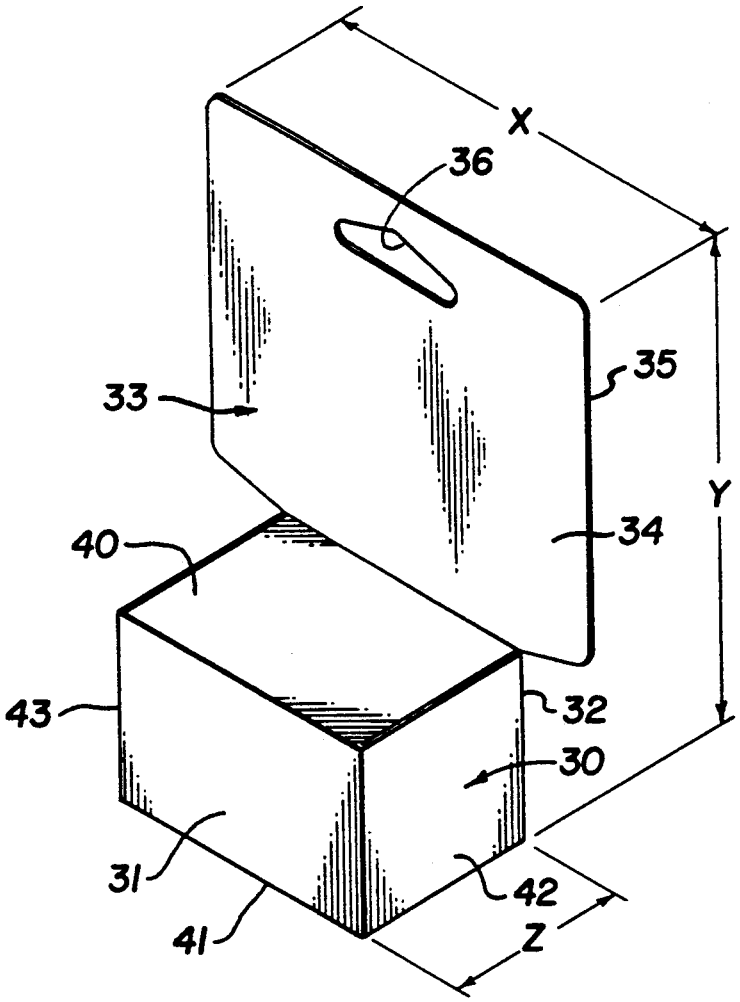
FIG. 3 is perspective view of a typical carded product which may be stored, displayed and dispensed in the dispenser illustrated in FIGS. 1 and 2.

Carded products obviously can take many forms. For purposes of this invention, the term "carded product" is used to mean any article which is polygonal in plan dimensions, has one substantially flat major face and an oppositely disposed substantially flat major face from which a portion of the article protrudes relatively near one edge thereof so that the articles can be nested to occupy less space than the space defined by the largest dimensions of the product. A typical carded product is illustrated in FIG. 3 wherein a rectangular box 30 having front and back oppositely disposed faces 31 and 32, respectively, is attached to a flat rectangular display card 33 having front and back oppositely disposed major faces 34 and 35, respectively. The carded product of FIG. 3 has a substantially flat back face which includes back face 35 as well as back face 32 of the box 30. As illustrated, the carded product has a lateral dimension X and a vertical dimension Y which define a somewhat rectangular card in plan dimension. The box 30 protrudes from the front face 34 of the card 33 in third dimension Z. The box 30 also has a top face 40 and bottom face 41 as well as opposed end faces 42 and 43. The card 33 has an aperture 36 centrally located near the upper edge thereof so that the carded product can be suspended from a peg or the like. It will be noted that when a plurality of such carded products are arranged front-to-back on a peg or the like, each carded product occupies the maximum space defined by dimensions X, Y and Z. However, if multiple carded products of FIG. 3 are nested so that the card portions 33 are arranged front-to-back with the box portions protruding in the Z direction arranged top-to-bottom, the nested products occupy substantially less space.

The carded product illustrated in FIG. 3 is typical of the packaging used for 35 mm film wherein a film canister is contained in box 30 and advertising and/or product identification material is graphically displayed on front face 34 of card 33. Various other products are packaged in similar arrangements and the term "carded product" is used herein for all such products whether or not the product includes a card as such or is merely configured in an embodiment having X and Y dimensions which define polygonal plan dimensions, a somewhat flat back face and a portion protruding in the Z direction off center from the front major face. Such carded products thus always exhibit irregular dimensions when viewed from an edge but may be stacked in a nested arrangement.

Figure 1:
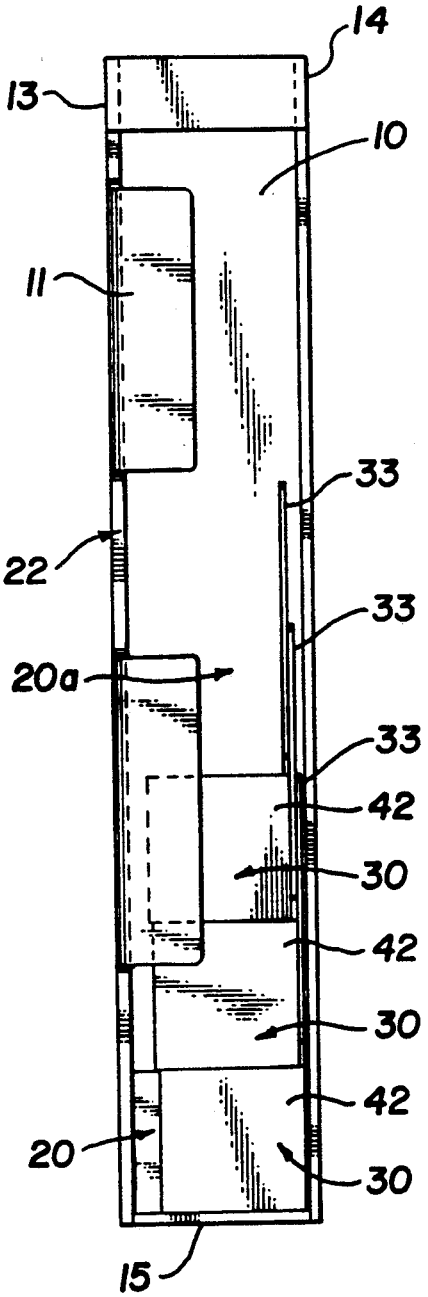
FIG. 1 is a front elevational view of a carded product dispenser constructed in accordance with the invention.
Figure 2:
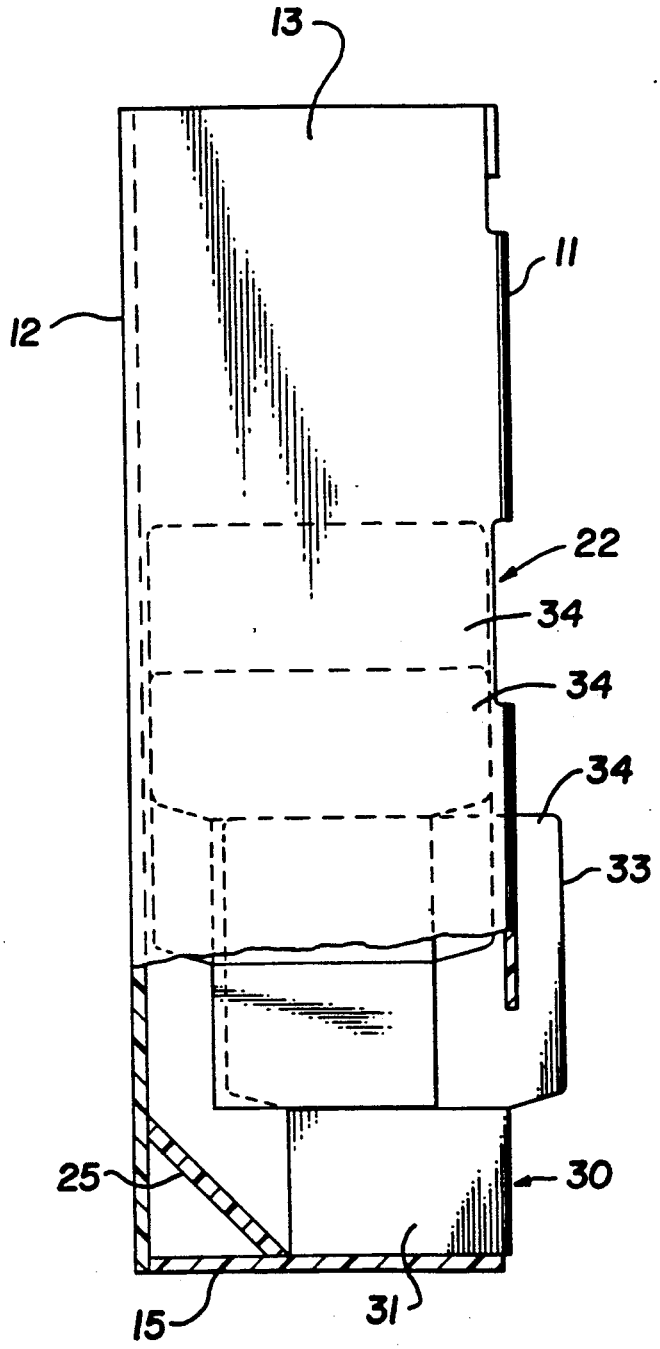
FIG. 2 is a side elevational view, partially in section, of the dispenser of FIG. 1.

The preferred embodiment of apparatus constructed in accordance with the present invention is illustrated in FIGS. 1 and 2. The apparatus illustrated comprises a substantially vertically extending channel 10 defined by front face 11, back face 12 and opposed lateral sides 13 and 14. The lower end of the channel is enclosed by a bottom 15 which may be provided as part of the apparatus or, of course, can be provided by the shelving or other surface upon which the dispensing display is positioned. Likewise, the back face 12 may be provided by a wall or the like adjacent which the dispensing apparatus is positioned when in use. The lateral sides 13 and 14 are positioned substantially parallel and spaced apart a sufficient distance to accommodate the protruding distance Z of the carded product as shown in FIG. 3.

In the illustration of FIGS. 1 and 2 the carded product of FIG. 3 is shown positioned therein for storage, display and dispensing. Note that the box 30 portion of the carded product is positioned in the channel 10 so that the end 42 is adjacent the front face 11 of the dispenser. The boxes 30 are stacked within the dispenser so that the box portions are stacked bottom-to-top and the card portions 33 are stacked back-to-front. In this manner, the carded product is vertically nested within the dispenser as illustrated and thus occupies minimum space.

The lower end of front face 11 defines an opening 20 adjacent the bottom 15. The opening 20 extends substantially the full width of the channel and upwardly for a distance greater than the vertical height of the box 30 but less than twice the vertical height of the box 30. The opening 20 has a vertically extending opening portion 20*a*. The width of opening 20*a* is less than the width of opening 20 and opening 20*a* extends vertically a distance at least as great as vertical dimension Y of the carded product.

The top of channel 10 is preferably open and the front-to-back depth of the channel is at least as great as the horizontal width X of the carded product. It will thus be observed that carded product as illustrated in FIG. 3 can be inserted from the top and stacked within the channel 10. Since the opening 20 at the bottom of front face extends substantially the full width of the front face, and since the front face 11 above the opening 20 prevents the removal of carded products from the dispenser, only the bottommost carded product can be withdrawn through opening 20. The extension 20*a* of opening 20 must extend at least as high as the vertical dimension Y of card 33. It will further be observed that when the lowermost carded product is removed, the remaining product will drop by force of gravity into the lower position permitting the second carded product to be removed. However, the front face 11 prevents removal of any carded product other than the one occupying the lowermost position in registry with opening 20.

As illustrated in FIG. 2, a foot 25 may be positioned near the bottom 15 and adjacent the back face 12 to urge the lowermost carded product forward As illustrated in FIG. 2, foot 25 comprises a member extending downwardly approximately 45° from the vertical so as to provide an inclined plane upon which the box portion 30 may ride as the lowermost box approaches the bottom 15. In this manner the lowermost box 30 is urged forward so that the card 33 of the lowermost carded product extends through the opening extension 20*a*. Foot 25 may be either a flat member as illustrated at 25 in FIG. 2 attached between the back face 12 and bottom 15 or may be simply an inwardly curved extension of the back face 12. Various other means for forming the foot 25, such as members extending inwardly from the sides 13, 14 and the like will be readily apparent to those skilled in the art.

It will be readily appreciated that carded product as described above can be nested and inserted through the top opening of the channel 10 and the channel filled with as many of such products as will be accommodated. The vertical height, of course, may vary depending upon the display space available. However, since the opening 20 only permits the lowermost box to be removed from the channel and the opening extension 20*a* permits only the lowermost card to be removed from the channel, only the lowermost carded product can be removed through the front face. Obviously, if new product is loaded at the top, the oldest product is always removed from the bottom. Accordingly, stocking clerks may merely fill the dispenser by adding new product at the top without removing older product.

While the front face 11 of the dispenser shown in FIGS. 1 and 2 only extends partially across the distance separating the walls 13 and 14, it will be appreciated that front face 11 may take other forms. It is only necessary that front face 11 have an opening at the lower end thereof which is larger than the irregular dimensions of the carded product occupying the lowermost position while retaining all carded products stacked above the lowermost carded product within the channel.

It will be appreciated that the vertical height of the dispenser may vary as required. In the embodiment illustrated, the top of channel 10 is open so that carded product may be loaded from the top only. It will be appreciated, however, that the front face 11 may be modified to provide an opening 22 near the top thereof so that carded product may be loaded from the front. To provide front loading capability, a portion of the entire front face 11 near the top and extending a vertical distance corresponding to the vertical height of the carded product may be removed, if desired. Carded product may then be inserted horizontally through such opening near the top and fall into the nested position shown in FIGS. 2 and 3.

It will be readily appreciated that while only a single channel embodiment of the invention is illustrated, multiple channels may be formed to provide adjacent dispensers of same or similar products wherein one wall will serve as a common wall between adjacent channels. It will further be recognized that the principles of the invention may be modified to accommodate various carded products of various dimensions and shapes.

In the preferred embodiment, the dispenser is fabricated from transparent materials so the graphic display shown on the carded product will be visible to the potential customer. Similarly, the dispenser may be provided with suspension means such as legs or hooks for wall mounting and may include additional display space formed thereon. Accordingly, it will be understood that while the invention has been described with particular reference to the preferred embodiment thereof, the form of the invention shown and described in detail is to be taken as the preferred embodiment of same and that various changes and modifications may be resorted without departing from the spirit and scope of the invention as defined by the appended claims.

What is claimed:

1. A dispenser for edge-first dispensing of carded product exhibiting a maximum vertical dimension Y, a maximum horizontal dimension X and a maximum thickness Z wherein the portion exhibiting dimension Z has a vertical dimension extending substantially the full length of the horizontal dimension which is substantially less than Y comprising:

(a) a front face and a back face defining a channel therebetween with a front-to-back depth at least as great as X;

(b) substantially parallel side faces defining a channel therebetween with a width at least as great as Z;

(c) a bottom substantially enclosing the lower end of the channel formed by said faces; and (d) an opening in said front face adjacent said bottom having dimensions substantially corresponding to the dimensions of the carded product in edge view and having a first vertical dimension which is less than twice the vertical dimension of the portion of the carded product having a dimension Z and a second vertical dimension which is at least as great as the vertical dimension Y.

2. A dispenser as defined in claim 1 including means positioned within said channel to urge the lowermost carded product occupying said channel toward said opening.

3. A dispenser as defined in claim 1 including an opening in the front face adjacent the top of the channel having a width at least as great as Z and a height at least as great as Y.

4. The combination of:

(a) a carded product exhibiting a maximum vertical dimension Y, a maximum horizontal dimension X and a maximum thickness Z wherein the portion exhibiting dimension Z has a vertical dimension extending substantially the full length of the horizontal dimension which is substantially less than Y; and (b) a dispenser for edge-first dispensing of such carded product comprising:

(i) a front face and a back face defining a channel therebetween with a front-to-back depth at least as great as X;

(ii) substantially parallel side faces defining a channel therebetween with a width at least as great as Z;

(iii) a bottom substantially enclosing the lower end of the channel formed by said faces; and (iv) an opening in said front face adjacent said bottom having dimensions substantially corresponding to the dimensions of the carded product in edge view and having a first vertical dimension which is less than twice the vertical dimension of the portion of the carded product having a dimension Z and a second vertical dimension which is at least as great as the vertical dimension Y.

5. The combination defined in claim 4 wherein said dispenser includes means positioned within said channel to urge the lowermost carded product occupying said channel toward said opening.

6. The combination defined in claim 4 wherein said dispenser includes an opening in the front face adjacent the top of the channel having a width at least as great as Z and a height at least as great as Y.

* * * * *